US006170423B1

(12) United States Patent
Suganuma

(10) Patent No.: US 6,170,423 B1
(45) **Date of Patent: *Jan. 9, 2001**

(54) WATERCRAFT BILGE SYSTEM

(75) Inventor: Noboru Suganuma, Hamamatsu (JP)

(73) Assignee: Sanshin Kogyo Kabushiki Kaisha, Shuzuika-Ken (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 09/267,738

(22) Filed: Mar. 15, 1999

Related U.S. Application Data

(63) Continuation-in-part of application No. 08/853,125, filed on May 8, 1997, now Pat. No. 5,881,664, which is a continuation of application No. 08/567,871, filed on Dec. 6, 1995, now Pat. No. 5,636,586, which is a continuation of application No. 08/369,872, filed on Jan. 6, 1995, now abandoned, which is a continuation of application No. 08/152,590, filed on Nov. 15, 1993, now abandoned.

(30) Foreign Application Priority Data

Nov. 16, 1992 (JP) ..... 4-330056

(51) Int. Cl.[7] ..... B63B 13/00
(52) U.S. Cl. ..... 114/183 R
(58) Field of Search ..... 114/183 R, 183 A, 114/184, 185

(56) References Cited

U.S. PATENT DOCUMENTS

| | | | | |
|---|---|---|---|---|
| 322,374 | | 7/1885 | Haydn . | |
| 349,497 | * | 8/1886 | Haydn | 114/185 |
| 422,391 | | 3/1890 | Frost . | |
| 1,554,244 | | 9/1925 | Verville . | |
| 1,856,367 | | 5/1932 | Aaron . | |
| 2,023,586 | | 12/1935 | Harrod . | |
| 2,604,867 | | 7/1952 | Frye . | |
| 2,624,305 | * | 1/1953 | Herrick et al. | 114/183 A |
| 2,891,499 | | 6/1959 | Skovranek . | |
| 3,180,301 | * | 4/1965 | Keller | 114/185 |
| 3,763,817 | * | 10/1973 | Francis | 114/183 R |
| 4,050,396 | * | 9/1977 | Ridgeway | 114/183 R |
| 4,787,328 | | 11/1988 | Inoue . | |
| 4,789,307 | | 12/1988 | Sloan . | |
| 4,850,908 | | 7/1989 | Nakase . | |
| 5,366,397 | | 11/1994 | Suganuma et al. . | |
| 5,636,586 | * | 6/1997 | Suganuma | 114/183 R |
| 5,881,664 | * | 3/1999 | Suganuma | 114/183 R |

FOREIGN PATENT DOCUMENTS

| | | | |
|---|---|---|---|
| 2-77391 | 3/1990 | (JP) | 114/183 R |

OTHER PUBLICATIONS

1990 Marine Products Catalog, The Rule Group, *Rule Industries, Inc.*, 70 Blanchard Road, Burlington, Massachusetts 01803 (6 pages).

* cited by examiner

*Primary Examiner*—Sherman Basinger
(74) *Attorney, Agent, or Firm*—Knobbe, Martens, Olson & Bear, LLP

(57) ABSTRACT

Several embodiments of bilge devices for small watercraft that permit the use of small capacity bilge pumps and which ensure that the bilge pumps will not run dry during abrupt maneuvers are disclosed. This result is obtained by using a trap-like device that permits water to accumulate from the bilge but which restricts the escape of the water during abrupt maneuvers

9 Claims, 4 Drawing Sheets

WATERCRAFT BILGE SYSTEM

RELATED CASES

This application is a continuation of application Ser. No. 08/853,125, filed May 8, 1997, now U.S. Pat. No. 5,881,664, issued Mar. 16, 1999, which is a continuation of application Ser. No. 08/567,871, filed Dec. 6, 1995, now U.S. Pat. No. 5,636,586, issued Jun. 10, 1997, which is a continuation of prior application Ser. No. 08/369,872, filed Jan. 6, 1995, now abandoned, which is a continuation of application Ser. No. 08/152,590, filed Nov. 15, 1993, now abandoned.

BACKGROUND OF THE INVENTION

This invention relates to a water jet propulsion unit and more particularly to an improved bilge device for removing water from the hull of a small watercraft.

There is a type of small watercraft which is extremely popular and which is designed to be operated by a rider and occupants in swimming suits. The reason for this is that this type of watercraft may frequently be subject to sudden maneuvers and cause the occupants to become wet. And, in some instances, the watercraft in fact may be capsized or partially capsized.

Of course, it is desirable to ensure that the bilge of the watercraft is kept relatively clear of water and hence, it is the practice to employ some form of bilge pump for this type of watercraft. Generally, the bilge pump has a pick-up conduit that is disposed at a low portion in the hull and which will pick up the water that accumulates in the bilge for pumping out. However, because of the fact that this type of watercraft is subjected to abrupt handling, the water in the bilge may flow to one side or the other, or to the front or the rear, and the pump will run dry. When the watercraft becomes more stable, although water may be returned to the inlet of the bilge pump, the air that has been drawn into the pumping system can cause the efficiency of the pump to decrease.

Of course, this problem could be partially reduced by providing a larger bilge pump, but this type of watercraft does not accommodate such larger units. In addition, even a larger capacity bilge pump may be subject to the aforenoted problems.

It is, therefore, a principal object to this invention to provide an improved bilge pump for a small watercraft.

It is a further object of this invention to provide a bilge pump for a small watercraft wherein it will be ensured that water is at the inlet to the bilge system at substantially all times.

SUMMARY OF THE INVENTION

This invention is adapted to be embodied in a bilge system for pumping bilge water from the hull of a small watercraft, and which is comprised of a hull having a lower wall of the bilge area. A water trap means is formed in the lower wall so as to trap and retain water regardless of abrupt changes in the direction of travel of the water pump. A bilge pump is provided for pumping bilge water, and a pick-up conduit means extend from the water trap means to the bilge pump for delivery of water thereto.

DETAILED DESCRIPTION OF THE PREFERRED EMBODIMENTS OF THE INVENTION

Figure 1:
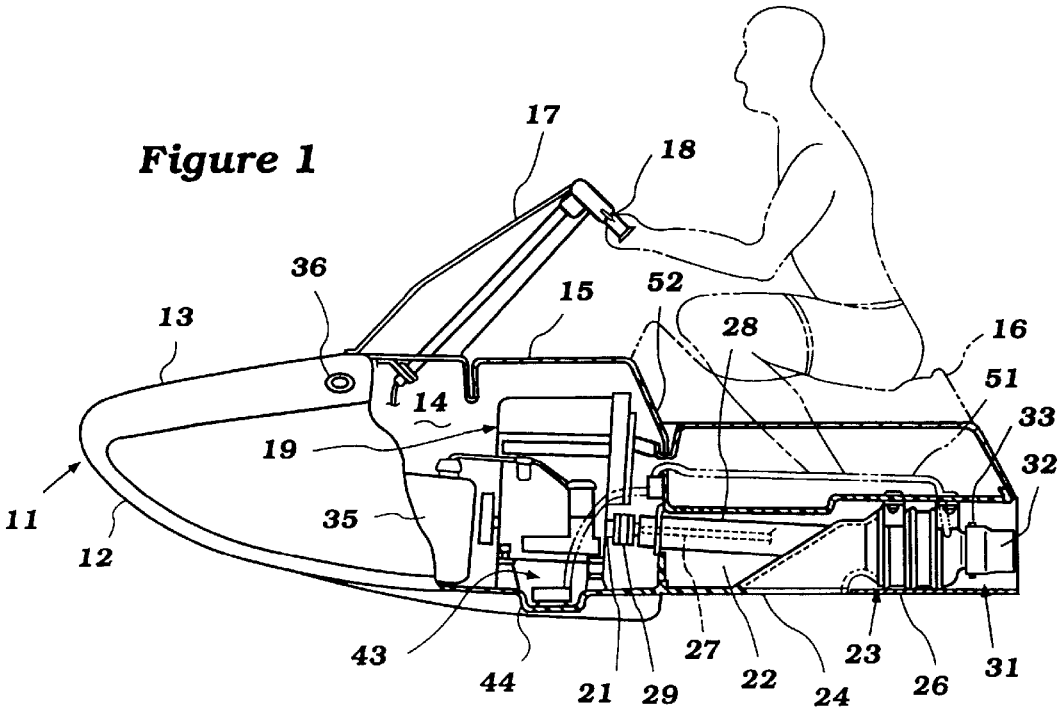
FIG. 1 is a side-elevational view of a small watercraft constructed in accordance with an embodiment of the invention, with a portion broken away and shown in sections and other portions shown in phantom.
Figure 2:
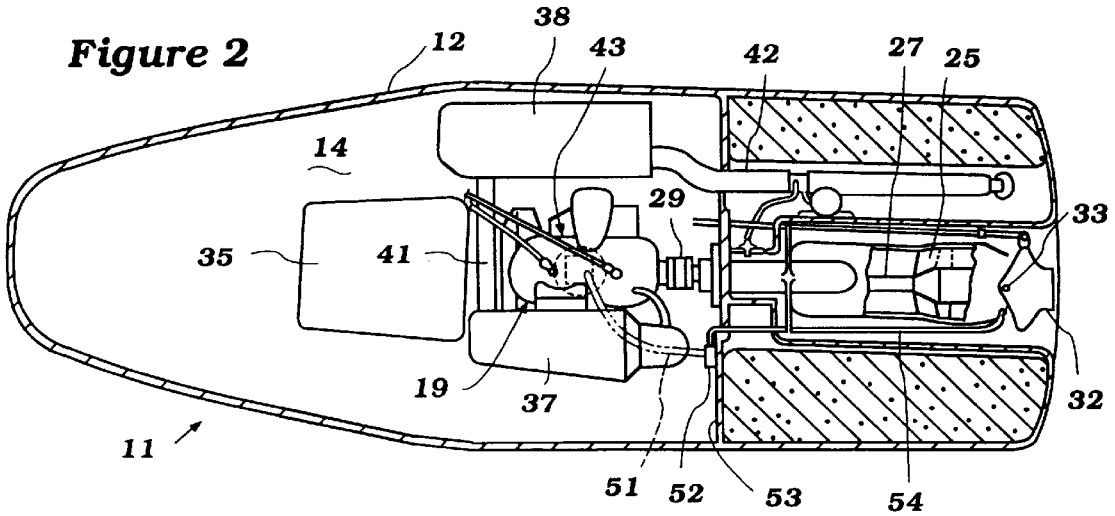
FIG. 2 is an enlarged top plan cross-sectional view taken through the center of the watercraft.

Referring first to FIGS. 1 and 2, a small watercraft embodying the invention is identified generally by the reference numeral 11. The type of small watercraft depicted is typical of that with which the invention may be utilized, but it should be readily apparent to those skilled in the art that the actual configuration of the watercraft is not a significant portion of the invention. The invention deals primarily with the bilge system for the watercraft 11, but a general description of the construction of the watercraft 11 will assist in understanding the construction and operation of the invention.

The watercraft 11 is comprised of a hull made up of a lower hull portion 12 and an upper deck portion 13 which may be formed from a suitable material such as a molded fiberglass reinforced resin or the like. The portions 12 and 13 are secured to each other in any suitable manner and define an engine compartment, indicated generally by the reference numeral 14 in which a number of components, to be described, are positioned. A removable hatch cover 15 affords access to the engine compartment 14.

A seat, shown in phantom and indicated generally by the reference numeral 16, is provided behind the hatch cover and is adapted to accommodate one or more riders seated in straddle, tandem fashion. A control mast 17 is disposed forwardly of the seat 16 and contains certain watercraft controls including a handle bar assembly 18 for steering the watercraft in a manner which will be described.

An internal combustion engine of any known type, indicated generally by the reference numeral 19, is supported in the engine compartment 14 and has an output shaft 21 which extends rearwardly toward a tunnel 22 formed in the underside of the hull 12 beneath the rider's seat 16. As seen in FIG. 1, an upper wall defines a portion of the tunnel 23. A jet propulsion unit, indicated generally by the reference numeral 23 is positioned in this tunnel 22 for powering the watercraft 11. The jet propulsion unit 23 may be of any known type and includes a downwardly facing water inlet duct 24, through which water is drawn under the action of an impeller 25 contained within an impeller housing 26. This impeller 25 is affixed for rotation with an impeller shaft 27 that extends forwardly through a tubular extension 28 of the housing 26, and is coupled by means of a resilient coupling 29 to the engine output shaft 21.

The water that has been pumped by the impeller 25 is discharged through a discharge nozzle assembly, indicated generally by the reference numeral 31, which includes a steering nozzle 32 that is supported for pivotal movement about a vertically extending steering axis on a pair of pivot pins 33. This steering nozzle 32 is connected to the handle bar assembly 18 for steering of the watercraft in a well-known manner.

Forwardly of the engine 19 in the engine compartment 14, there is positioned a fuel tank 34 which supplies fuel to the engine 19 for its operation in a well-known manner. A fill neck and fill cap 36 extend through the deck portion 13 on one side of the mast 17 for replenishing the fuel tank 35.

The engine also includes various well-known accessories such as a combined exhaust manifold and silencing arrangement which is cooled by the coolant for the engine 19 and which is indicated generally by the reference numeral 37. Position on the opposite side of the engine 19 is a water trap and expansion chamber device 38 which receives exhaust gases from manifold 37 through a connecting conduit 41. These exhaust gases are then discharged to the atmosphere back through the body of water in which the watercraft is operating by an exhaust pipe 42.

The foregoing description is, as noted, only for environmental purposes and the invention deals primarily with the bilge water removal system for the watercraft 11, this being indicated generally by the reference numeral 43 and which is shown in more detail in the remaining figures and will now be described by a reference to that. It is to be understood that the various embodiments of FIGS. 3 and 4, 5 and 6, 7, 8 and 9, and 10 and 11 will be positioned substantially as shown in FIGS. 1 and 2. Different types of water traps, to be described, will, however, be described in conjunction with each embodiment.

Figure 3:
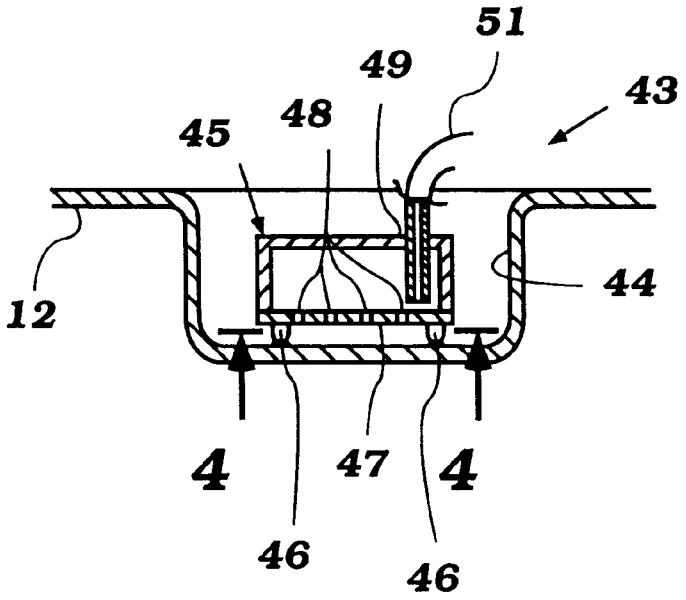
FIG. 3 is an enlarged cross-sectional view showing a first embodiment of bilge pick-up device.
Figure 4:
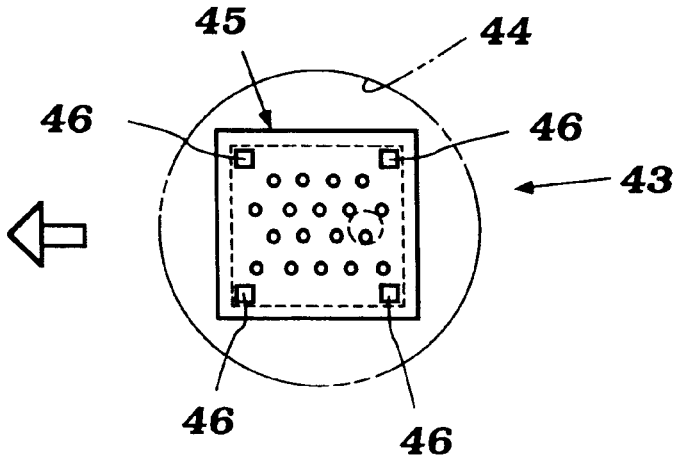
FIG. 4 is a view taken in the direction of the line 4—4 of 3.

Referring now in detail to FIGS. 3 and 4, the trap device 43 is comprised of a well 44 and is formed in the central portion of the lower hull 12, approximately midway between the sides of the hull 12 and also in the center in the longitudinal direction. The well 44 need have only a relatively small volume so as to trap a small volume of water during abrupt maneuvers when all water might, but for the well 44, move to one side of the hull. Also, since a relatively small bilge pump is provided, the well 44 can be relatively small.

A further trap arrangement comprised of a generally rectangular box-like water pick-up 45 has four foot-like pedestals 46 that raise a lower wall 47 thereof a slight distance above the lower wall of the well 44. This lower wall 47 is provided with a plurality of peripheral openings 48 so that water which accumulates in the well 44 may be drawn into an internal cavity of the pick-up 45.

One end 49 of a flexible conduit 51 depends on the pick-up 45 and terminates slightly above the lower wall 47. The conduit 51 then extends to a bilge pump 52 (FIGS. 1 and 2) that is mounted on a bulk head 53 of the hull adjacent the tunnel 22. The bilge pump 52 may be a small electrical pump driven by a battery (not shown) and discharges the bilge water pumped by it through a conduit 54 back into the body of water in which the watercraft is operating. In the illustrated embodiment, the conduit 54 extends into the discharge nozzle portion 31 of the jet propulsion unit 23 immediately upstream of the steering nozzle 32. Of course, other discharge points may be employed.

As previously noted, because of the relatively small capacity of the bilge pump 52 and the provision of the well or trap 43, any abrupt movements will not cause all water to move out of the well 44 and the trapped water will continue to be pumped by the bilge pump 52 even during these maneuvers. As a result, air never enters in the bilge water system.

Figure 5:
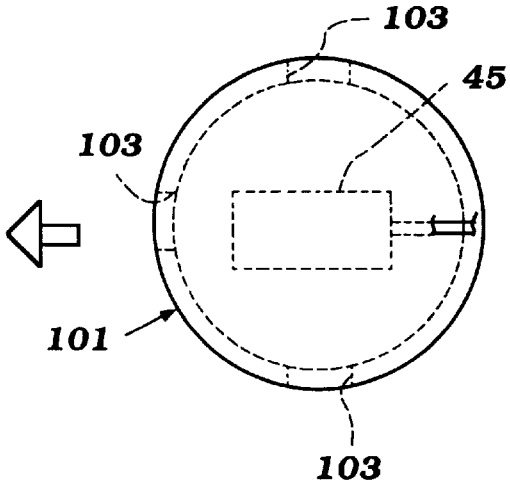
FIG. 5 is a top plan view of another form of bilge water pickup device.
Figure 6:
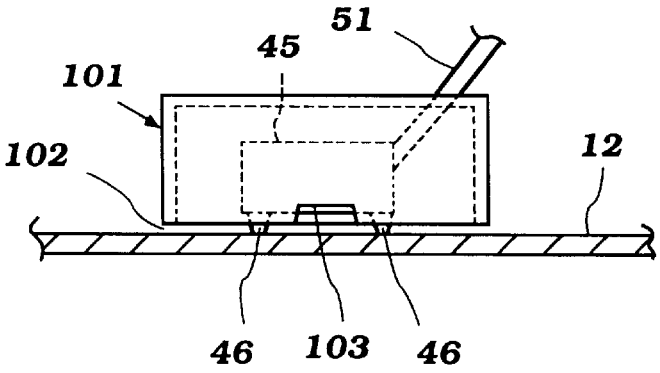
FIG. 6 is a side elevational view of this embodiment.

As has been previously noted, other forms of trap devices may be employed and FIGS. 5 and 6 show another form of trap device which does not necessarily require a well in the hull portion 12. It is to be understood, however, that this embodiment can also be utilized with such a well, but, as will become apparent to those skilled in the art, a different type of arrangement is provided for trapping water.

In this embodiment, the pickup device 45 is the same as that previously described and only the trap forming portion is different. For that reason, the pickup device 45 has been identified by the same reference numeral in this figures and further description of it is not believed to be necessary.

In accordance with this embodiment, a trap forming member, indicated generally by the reference number 101, is positioned so as to be held at a small distance above the upper surface of the hull portion 12, as by means of the same pedestals 46 which hold the pickup device 45 above the floor. That is, the trap device 101 may be supported on the pickup device 45 so as to provide a relatively small gap 102 through which water may flow. In addition, there are relatively narrow slots 103 formed in a forwardly facing position and insidewardly facing positions that will permit water to flow into and out of the trap 101 but at a relatively restricted rate. Normally, the trap 101 will be submerged with bilge water. However, if there is an abrupt movement, the flow of water out of the trap 101 will be retarded by the restrictions of the gap 102 and slots 103 and hence this area will never be completely out of water during the abrupt maneuvering and, like the previously described embodiment, the bilge pump 52 will never run dry.

Figure 7:
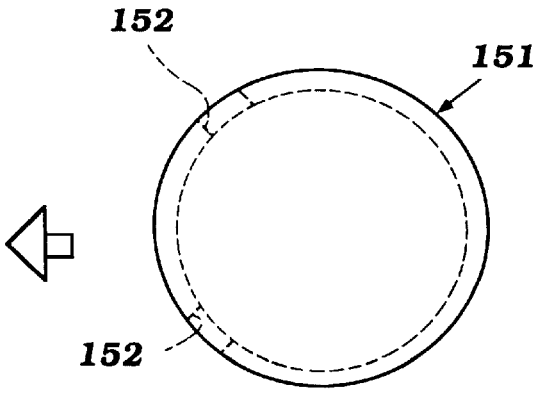
FIG. 7 is a top plan view, in part similar to FIG. 5, and shows a further embodiment of the invention.

Another form of trap forming device is shown in FIG. 7 and is identified generally by the reference numeral 151. This embodiment differs form the embodiment of FIGS. 5 and 6 only in the way in which the water is permitted to flow into and out of the trap forming member 151. In this embodiment, rather than a forwardly facing and sidewardly facing slots there are provided a pair of slots 152 that are disposed in a generally forwardly facing direction but are rotated slightly to the side. In all other regards, this embodiment is the same as was previously described and, for that reason, further description of this embodiment is not believed to be necessary to understand the construction and operation.

Figure 8:
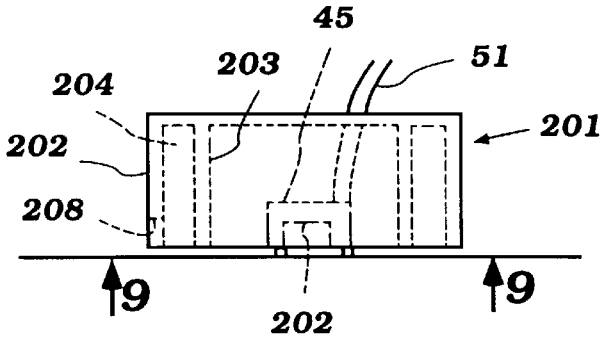
FIG. 8 is a side elevational view of yet another embodiment of the invention.
Figure 9:
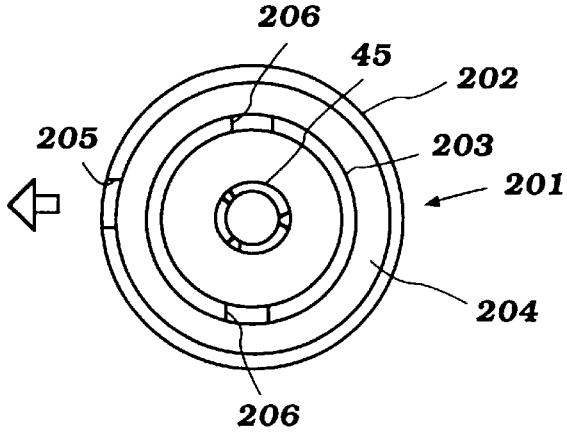
FIG. 9 is a bottom plan view taken along the line 9—9 of FIG. 8.

FIGS. 8 and 9 show another embodiment of trap, indicated generally by the reference numeral 201. In this embodiment, the trap 201 has an inverted cup shape with an outer cylindrical wall 202 and an inner-cylindrical wall 203 which define a first cavity 204 there between. Water is admitted to this first cavity 204 through a restricted slot 205 formed in the front lower portion of the outer wall 202.

The inner wall 203 has a pair of slots 206 which are disposed at 90° to the slot 205. That is, the slots 206 extend from side to side while the slot 205 extends forwardly. As a result of this construction, there is a labyrinthian flow path for the water from the cavity formed around the pickup 45 by the inner wall 203 and the cavity 204 formed between the outer and inner walls 202 and 203, respectively, that will trap water and preclude its rapid exit away from the pickup device 45 during abrupt maneuvers.

Figure 10:
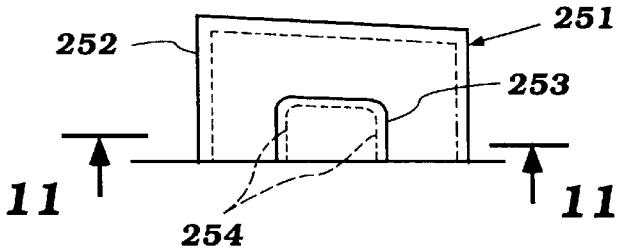
FIG. 10 is a side elevational view of a still further embodiment of the invention.
Figure 11:
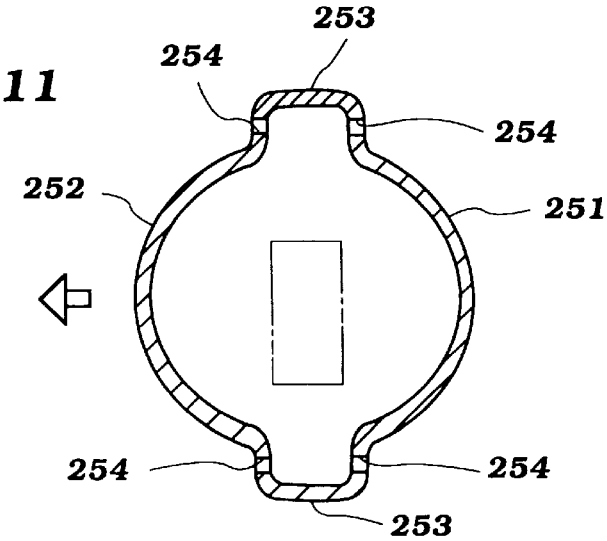
FIG. 11 is a cross-sectional view taken along the line 11—11 of FIG. 10.

A still further embodiment of trap device is shown in FIGS. 10 and 11 and is identified generally by the reference numeral 251. This trap device 251 is comprised of an outer shell 252 having a pair of ear-like projections 253 extending on its opposite sides and away from the fore and aft direction. Also, the upper surface of this device may be slightly downwardly tapered toward the rear. Except for the lug-like portions 253 the outer wall 252 is imperforate. However, a pair of small restricted slots 254 are formed in the forwardly and rearwardly facing portions of the lugs 253 so as to trap water in the interior of the device and let it flow out only slowly when abrupt maneuvers are being performed. Therefore, like the previously described embodiment, the bilge will not run dry during such maneuvers.

It should be readily apparent from the foregoing description that the various trap device is depicted and described are effective in ensuring that the bilge pump of the watercraft will not run dry during abrupt maneuvers. This is accomplished without restricting the device's ability to pump bilge water out during normal running. Of course, the foregoing description is that of preferred embodiments of the invention and various changes and modifications may be made without departing from the spirit and scope of the invention, as defined by the appended claims.

What is claimed is:

1. A bilge system for removing water from a bilge area of a hull of a small watercraft having a propulsion device, said bilge system comprising a mechanical bilge pump that operates independently of the propulsion device and continuously during watercraft maneuvers involving abrupt changes in direction of travel, said bilge pump having an inlet, and a water trap connected to said bilge pump such that bilge water must pass through said water trap to enter said inlet, said water trap being configured so that when bilge water is present in the bilge, a portion of said bilge water is in communication with said inlet at substantially all times.

2. A bilge system for pumping bilge water from the hull of a small watercraft as in claim 1, wherein said water trap includes an internal cavity and a wall surrounding said internal cavity, said wall having a plurality of openings creating a plurality of flow paths between the bilge area and said bilge pump to restrict the flow of bilge water from the internal cavity to the bilge area upon abrupt changes in the direction of travel of the watercraft.

3. A bilge system for pumping bilge water from the hull of a small watercraft as in claim 1, wherein the volume of water contained by said water trap is formed above the surface of a lower wall of the bilge area.

4. A bilge system for pumping bilge water from the hull of a small watercraft as in claim 1, wherein said water trap comprises an inverted cup-like member defining an internal volume and having upstanding walls with one or more side openings to form restricted flow paths therein.

5. A bilge system for pumping bilge water from the hull of a small watercraft as in claim 1, wherein said water trap includes an outer wall having one or more openings therein, and an inner element enclosed by said outer wall, said inner element providing resistance to fluid flow.

6. A bilge system for pumping water from the hull of a small watercraft as in claim 1, wherein said water trap means is positioned beneath an engine of the watercraft disposed within said hull.

7. A bilge system for pumping bilge water from the hull of a small watercraft as in claim 1, wherein said water trap means is formed at least in part by a recessed area extending downwardly in said hull.

8. A bilge system as in claim 1, wherein said water trap includes a well formed in a lower wall of the bilge area.

9. A bilge system as in claim 8, wherein said well is positioned at the center of the hull beneath an engine housed within the hull.

* * * * *